US010231548B2

(12) United States Patent
Zhu et al.

(10) Patent No.: US 10,231,548 B2
(45) Date of Patent: Mar. 19, 2019

(54) DOUBLE FOLDING CHAIR WITH ROTATION ANGLES

(71) Applicant: ZHEJIANG SUNSHINE LEISURE PRODUCTS CO., LTD., Jinhua, Zhejiang Province (CN)

(72) Inventors: Xiaohui Zhu, Jinhua (CN); Xuefeng Zheng, Jinhua (CN)

(73) Assignee: ZHEJIANG SUNSHINE LEISURE PRODUCTS CO., LTD., Jinhua, Zhejiang Province (CN)

( * ) Notice: Subject to any disclaimer, the term of this patent is extended or adjusted under 35 U.S.C. 154(b) by 5 days.

(21) Appl. No.: 15/801,614

(22) Filed: Nov. 2, 2017

(65) Prior Publication Data

US 2019/0038029 A1 Feb. 7, 2019

(30) Foreign Application Priority Data

Aug. 1, 2017 (CN) ..... 2017 2 0949006 U

(51) Int. Cl.

| | |
|---|---|
| ***A47C 4/32*** | (2006.01) |
| ***A47C 4/28*** | (2006.01) |
| ***A47C 1/14*** | (2006.01) |
| ***A47C 7/02*** | (2006.01) |
| ***A47C 4/42*** | (2006.01) |

(52) U.S. Cl.

CPC ..... *A47C 4/283* (2013.01); *A47C 1/14* (2013.01); *A47C 4/32* (2013.01); *A47C 4/42* (2013.01); *A47C 7/024* (2013.01)

(58) Field of Classification Search

CPC .. A47C 4/283; A47C 1/14; A47C 4/32; A47C 4/42; A47C 7/024

See application file for complete search history.

(56) References Cited

U.S. PATENT DOCUMENTS

| | | | | |
|---|---|---|---|---|
| 6,231,119 | B1 * | 5/2001 | Zheng | A47C 4/286 297/45 X |
| 7,070,230 | B2 * | 7/2006 | Chen | A47C 4/286 297/44 |
| 7,648,196 | B2 * | 1/2010 | Degelman | A47C 4/286 297/45 |

* cited by examiner

*Primary Examiner* — Anthony D Barfield

(74) *Attorney, Agent, or Firm* — Muncy, Geissler, Olds & Lowe, P.C.

(57) ABSTRACT

The invention discloses a double folding chair with rotation angles. The double folding chair comprises four backrest pipes and two armrest pipes, wherein the a wrest pipes and the backrest pipes form a folding chair frame, rotation-angle transverse-bracing pipes are arranged between the two backrest pipes in the middle so that a flare angle can be formed between two chair backs, and intermediate connecting pieces which can rotate coaxially are arranged on a front support of the folding chair frame so as to be matched with the rotation-angle transverse-bracing pipes. Since the flare angle can be formed between two chair bodies, chair users can communicate conveniently, and the double folding chair has the advantages of being reasonable in structure, good in user experience etc.

6 Claims, 6 Drawing Sheets

DOUBLE FOLDING CHAIR WITH ROTATION ANGLES

BACKGROUND OF THE INVENTION

Technical Field

The invention discloses a double folding chair with rotation angles, and belongs to the technical field of folding chairs according to International Patent Classification (IPC).

Description of Related Art

Most existing folding chairs are single-seat chairs and can only be used by one person, people need to carry multiple chairs when going out for recreation, and consequentially certain trouble is caused to people. The Chinese document with the application number of CN201020641623.4 discloses a double folding chair, two seats are located on the same plane in the technical scheme, so that people have to lean their bodies when chatting for relaxation and have to change certain sitting postures for face-to-face communication, and the effect of user experience is poor.

BRIEF SUMMARY OF THE INVENTION

For overcoming the defects of the prior art, the invention provides a double folding chair with rotation angles, a flare angle can be formed between chair backs, and thus chair users can communicate with each other conveniently.

For achieving the above purpose, the following technical scheme is adopted by the invention:

A double folding chair with rotation angles comprises four backrest pipes and two armrest pipes, wherein the armrest pipes and the backrest pipes form a folding chair frame, rotation-angle transverse-bracing pipes are arranged between the two backrest pipes in the middle so that a flare angle can be formed between two chair backs, and intermediate connecting pieces which can rotate coaxially are arranged on a front support of the folding chair frame so as to be matched with the rotation-angle transverse-bracing pipes.

Furthermore, the upper portions of the armrest pipes are hinged with armrest clamping pieces in a matched mode, and the lower ends of the armrest pipes are hinged with the intermediate connecting pieces, the middle portions of the armrest pipes are each hinged with a cross pipe, the upper ends of the cross pipes are hinged with the intermediate connecting pieces, the lower ends of the cross pipes are hinged with foot pads, and the armrest pipes and the cross pipes form the front support of the folding chair frame.

Furthermore, the backrest pipes are hinged with foot pads, and sliding connecting pieces are arranged on the backrest pipes; one ends of first connection bracing pipes are hinged with the intermediate connecting pieces, and the other ends of the first connection bracing pipes are hinged with the sliding connecting pieces; one ends of second connection bracing pipes are hinged with the intermediate connecting pieces, and the other ends of the second connection bracing pipes are hinged with the foot pads; the first connection bracing pipes and the second connection bracing pipes form an intermediate support of the folding chair frame.

Furthermore, the folding chair frame comprises four sets of cross pipes, every two sets of cross pipes are hinged to form an X shape, the four sets of cross pipes are hinged with the sliding connecting pieces, the foot pads and the armrest clamping pieces respectively, and the four sets of cross pipes and the backrest pipes form a rear support and side supports of the folding chair frame.

Furthermore, the two sets of rotation-angle transverse-bracing pipes are hinged end-to-end, and the two ends of each set of rotation-angle transverse-bracing pipe are hinged to one foot pad and one sliding connecting piece respectively Furthermore, each intermediate connecting piece comprises a first intermediate connecting piece body and a second intermediate connecting piece body, the second intermediate connecting piece body is provided with a convex shaft which is matched with a slot of the first intermediate connecting piece body, and then the first intermediate connecting piece body and the second intermediate connecting piece body are connected through a connecting hole and can rotate coaxially to form a certain angle.

By adoption of the double folding chair of the invention, the problems that in the prior art, seat surfaces of a double folding chair are located on the same plane and cannot deflect, consequentially, people cannot communicate conveniently after sitting on the chair, and the folding chair can only be used by one person are solved. The included angles between two chair bodies can be changed through cooperation of the intermediate connecting pieces and the rotation-angle transverse-bracing pipes, so that the flare angle is formed, chair users can communicate conveniently, and the double folding chair has the advantages of being reasonable in structure and good in user experience.

DETAILED DESCRIPTION OF THE INVENTION

Figure 1:
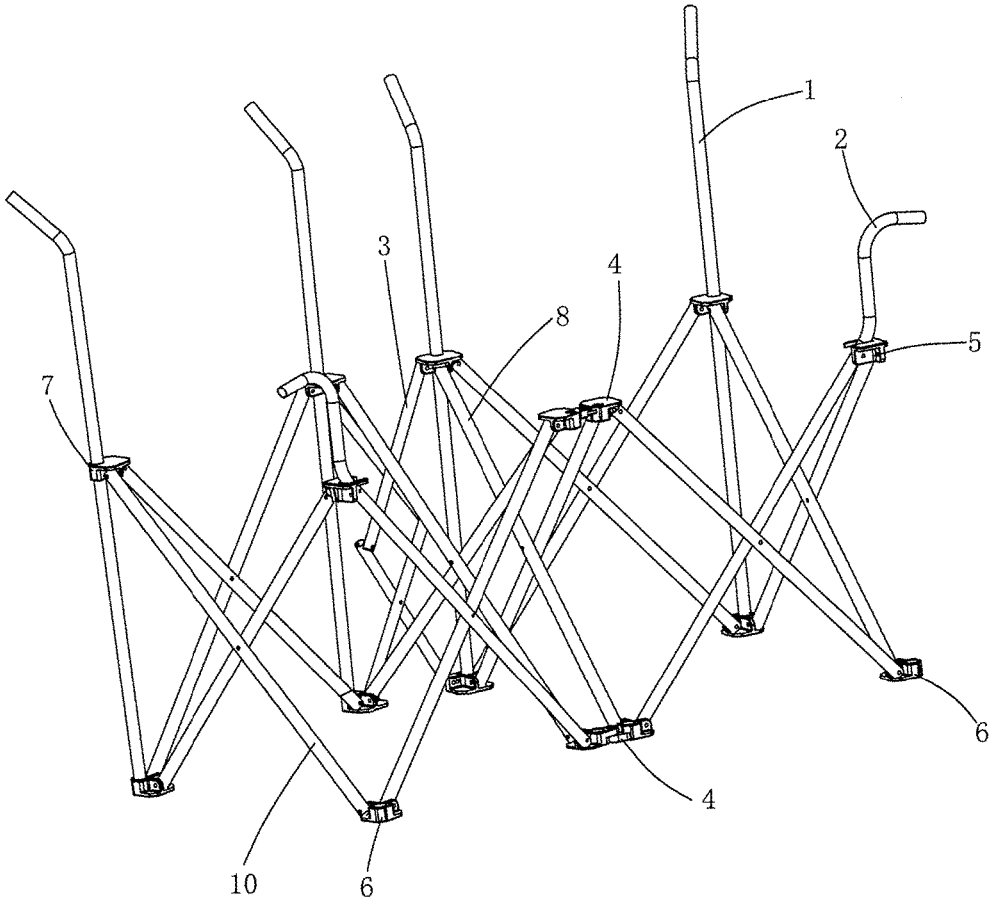
FIG. 1 is a diagram of an embodiment of the invention in the unfolded state.
Figure 2:
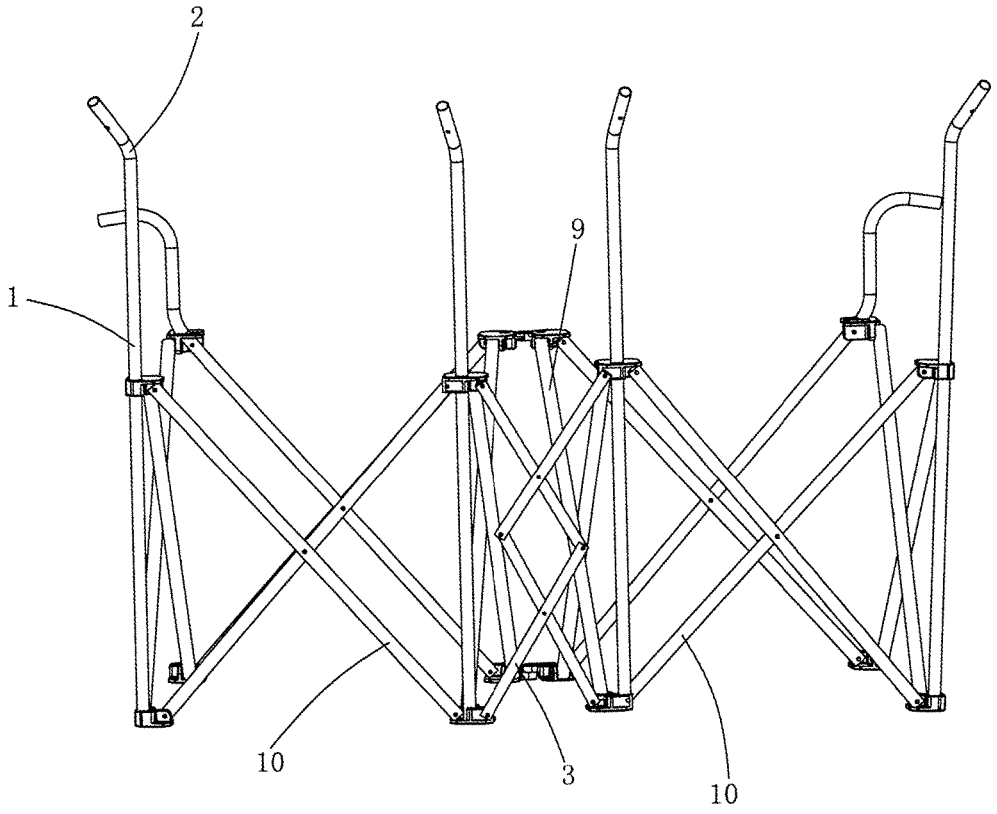
FIG. 2 is a rear view of the embodiment of the invention.
Figure 3:
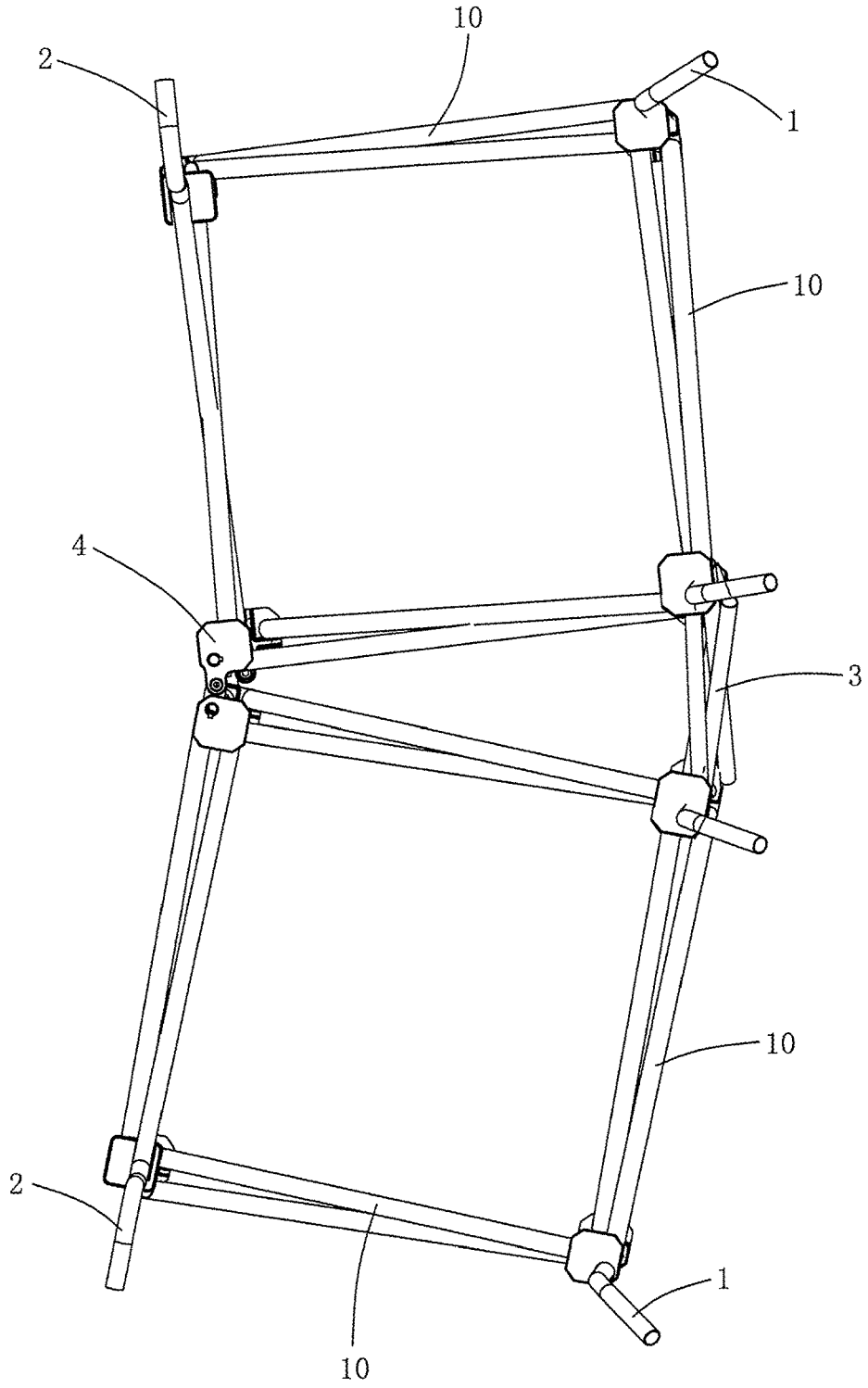
FIG. 3 is a top view of the embodiment of the invention.
Figure 4:
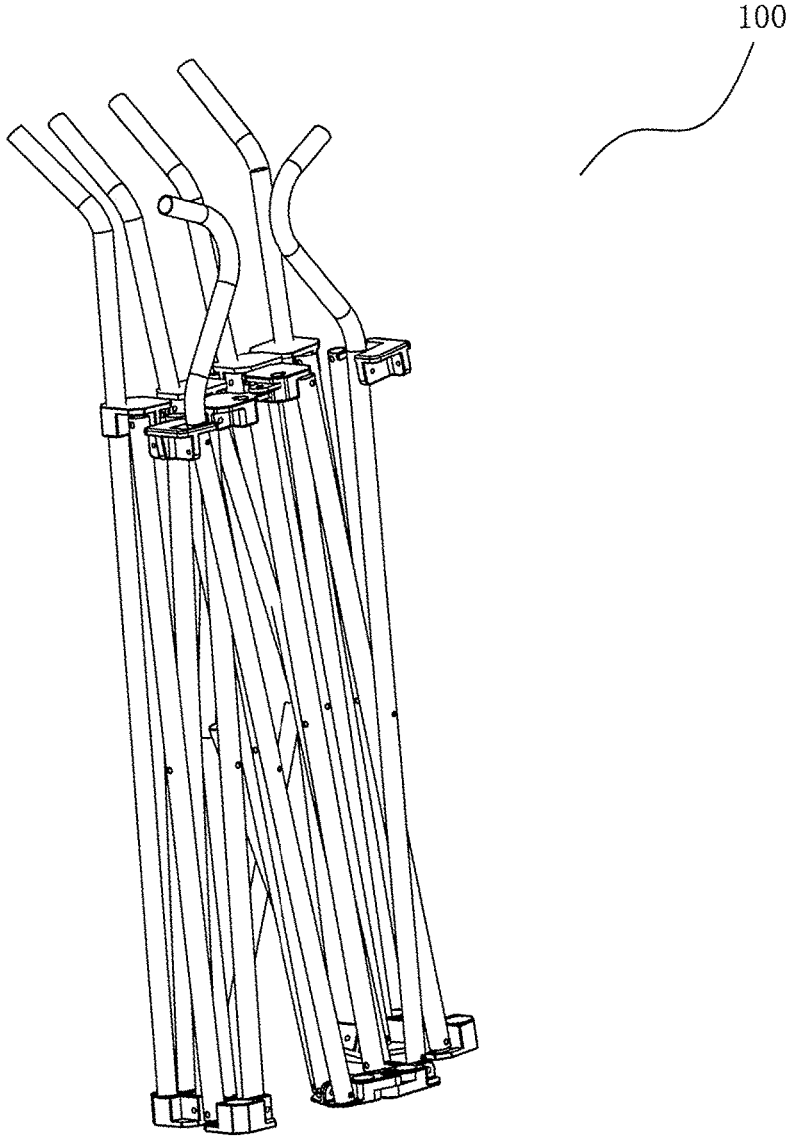
FIG. 4 is a diagram of the embodiment of the invention in the folded state.
Figure 5:
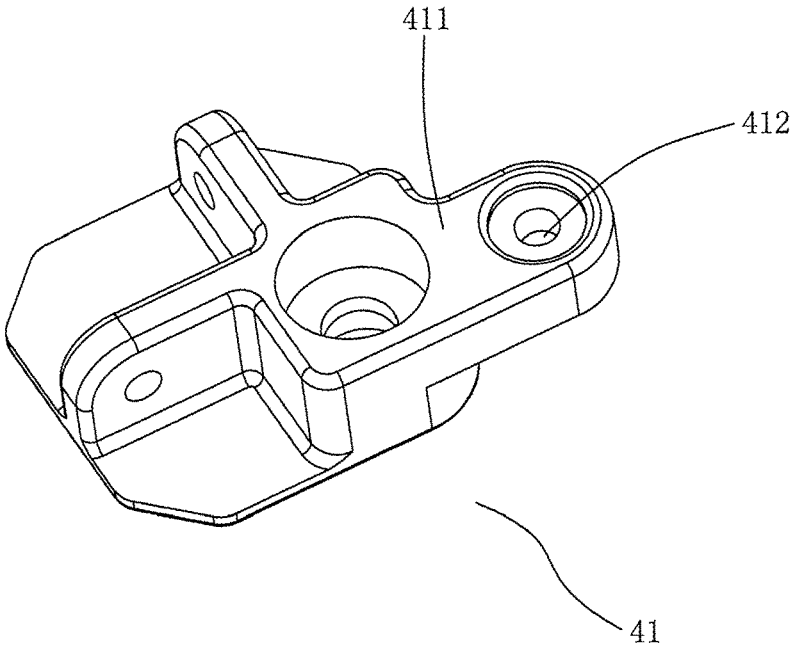
FIG. 5 is a schematic diagram of a first intermediate connecting piece.
Figure 6:
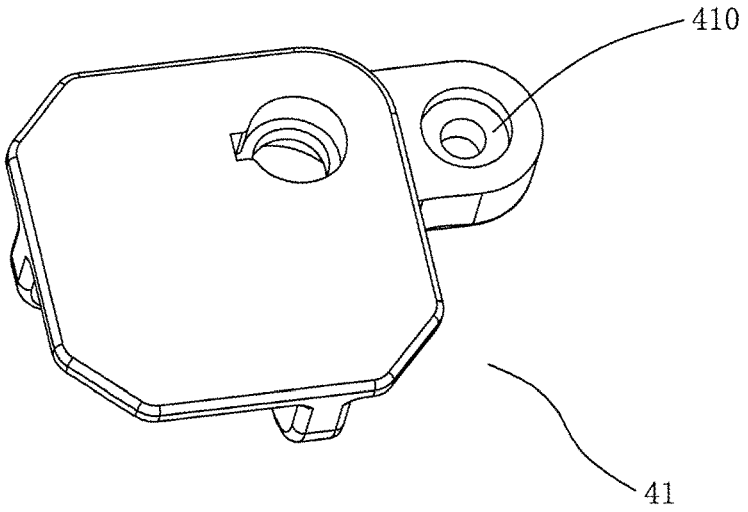
FIG. 6 is another schematic diagram of the first intermediate connecting piece.
Figure 7:
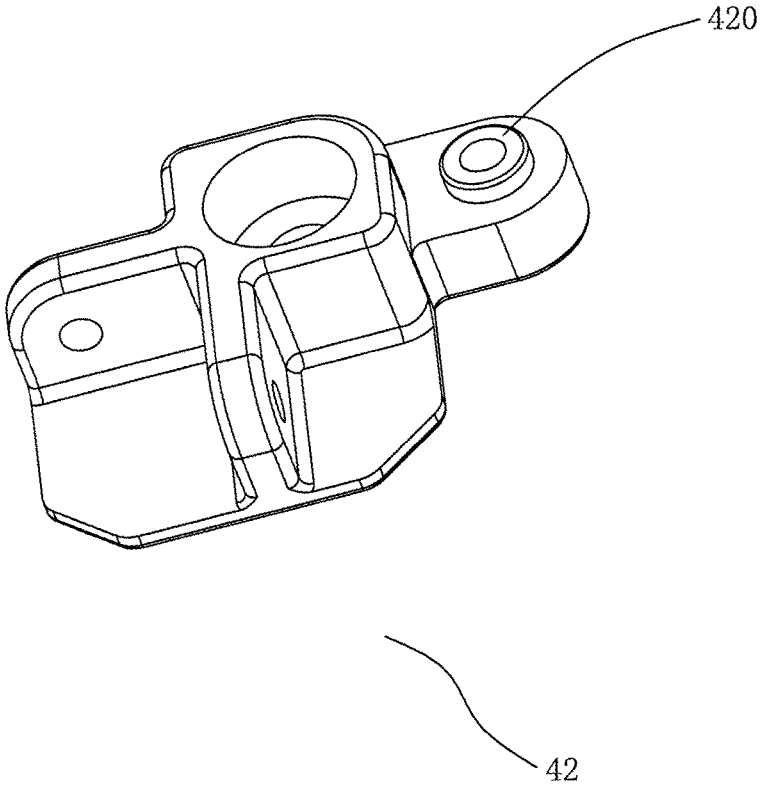
FIG. 7 is a schematic diagram of a second intermediate connecting piece.

A further description of the invention with accompanying drawings is given as follows:

Embodiment: please see FIGS. 1-7, a double folding chair 100 with rotation angles comprises four backrest pipes 1 and two armrest pipes 2, the armrest pipes 2 and the backrest pipes 1 form a folding chair frame, and rotation-angle transverse-bracing pipes 3 are arranged between the two backrest pipes in the middle so that a flare angle can be formed between two chair backs; intermediate connecting pieces 4 which can rotate coaxially are arranged on a front support of the folding chair frame so as to be matched with the rotation-angle transverse-bracing pipes 3. The upper portions of the armrest pipes 2 are hinged with armrest clamping pieces 5 in a matched mode, the lower ends of the armrest pipes 2 are hinged with the intermediate connecting pieces 4, and meanwhile, the middle portions of the armrest pipes 2 are each hinged with a cross pipe; the upper ends of the cross pipes are hinged with the intermediate connecting pieces 4, the lower ends of the cross pipes are hinged with foot pads 6, and the armrest pipes and the cross pipes form the front support of the folding chair frame. The backrest pipes 1 are hinged with foot pads, and sliding connecting pieces 7 are arranged on the backrest pipes; one ends of first connection bracing pipes 8 are hinged with the intermediate connecting pieces 4, and the other ends of the first connection bracing pipes 8 are hinged with the sliding connecting pieces 7; one ends of second connection bracing pipes 9 are hinged with the intermediate connecting pieces, and the other end of the second connection bracing pipes 9 are hinged with the foot pads; the first connection bracing pipes and the second connection bracing pipes form an intermediate support of the folding chair frame. The folding chair frame comprises four sets of cross pipes 10, every two sets of cross pipes 10 are hinged to form an X shape, the four sets of cross pipes 10 are hinged with the sliding connecting pieces 7, the foot pads 6 and the armrest clamping pieces 5 respectively, and the four sets of cross pipes and the backrest pipes form a rear support and side supports of the folding chair frame. The two sets of rotation-angle transverse-bracing pipes 3 are hinged end-to-end, and the two ends of each set of rotation-angle transverse-bracing pipe 3 are hinged with one foot pad and one sliding connecting piece respectively. Each intermediate connecting piece 4 comprises a first intermediate connecting piece body 41 and a second intermediate connecting piece body 42, wherein matched stretching-out blocks 411 are arranged on the first intermediate connecting piece body and the second intermediate connecting piece body, the second intermediate connecting piece body is provided with a convex shaft 420, the convex shaft 420 is matched with a slot 410 of the first intermediate connecting piece body 41, and then the first intermediate connecting piece body 41 and the second intermediate connecting piece body 42 are connected through a connecting hole 412 and can rotate coaxially to form a certain angle.

In the invention, the intermediate connecting pieces 4 make contact with one another through the stretching-out blocks and are connected through the connecting holes 412, and every two corresponding intermediate connecting bodies rotate coaxially to form a certain angle; meanwhile, the two edge structures are connected so that the double folding chair can be used by two persons at the same time. The rotation-angle transverse-bracing pipes 3 are hinged end-to-end and connected with one another so that a flare angle can be formed between the chair backs, and meanwhile, the rotation angles can be changed by changing the hinge positions. After a certain angle is formed, people can communicate with each other conveniently without changing the sitting postures. The bearing stability of the chair is ensured through the connection bracing pipes when the chair is unfolded.

The foregoing description is only the embodiment based on the technical content of the invention, modifications and changes which are made by anyone familiar with the technique are all within the patent scope of the claims of the invention, and the invention is not limited to the embodiment disclosed above.

What is claimed is:

1. A double folding chair with rotation angles, comprising four backrest pipes and two armrest pipes, wherein the armrest pipes and the backrest pipes form a folding chair frame, rotation-angle transverse-bracing pipes are arranged between the two backrest pipes in the middle so that a flare angle is configured to be formed between two chair backs, and intermediate connecting pieces which can rotate coaxially are arranged on a front support of the folding chair frame so as to be matched with the rotation-angle transverse-bracing pipes.

2. The double folding chair with rotation angles according to claim 1, wherein the upper portions of the armrest pipes are hinged with armrest clamping pieces in a matched mode, and the lower ends of the armrest pipes are hinged with the intermediate connecting pieces, the middle portions of the armrest pipes are each hinged with a cross pipe, the upper ends of the cross pipes are hinged with the intermediate connecting pieces, the lower ends of the cross pipes are hinged with foot pads, and the armrest pipes and the cross pipes form the front support of the folding chair frame.

3. The double folding chair with rotation angles according to claim 1, wherein the backrest pipes are hinged with foot pads, and sliding connecting pieces are arranged on the backrest pipes; one ends of first connection bracing pipes are hinged with the intermediate connecting pieces, and the other ends of the first connection bracing pipes are hinged with the sliding connecting pieces; one ends of second connection bracing pipes are hinged with the intermediate connecting pieces, and the other ends of the second connection bracing pipes are hinged with the foot pads; the first connection bracing pipes and the second connection bracing pipes form an intermediate support of the folding chair frame.

4. The double folding chair with rotation angles according to claim 1, wherein the folding chair frame comprises four sets of cross pipes, every two sets of cross pipes are hinged to form an X shape, the four sets of cross pipes are hinged with the sliding connecting pieces, the foot pads and the armrest clamping pieces respectively, and the four sets of cross pipes and the backrest pipes form a rear support and side supports of the folding chair frame.

5. The double folding chair with rotation angles according to claim 1, wherein the two sets of rotation-angle transverse-bracing pipes are hinged end-to-end, and the two ends of each set of rotation-angle transverse-bracing pipe are hinged to one foot pad and one sliding connecting piece respectively.

6. The double folding chair with rotation angles according to claim 1, wherein each intermediate connecting piece comprises a first intermediate connecting piece body and a second intermediate connecting piece body, the second intermediate connecting piece body is provided with a convex shaft which is matched with a slot of the first intermediate connecting piece body, and then the first intermediate connecting piece body and the second intermediate connecting piece body are connected through a connecting hole and can rotate coaxially to form a certain angle.

* * * * *